US011643782B2

(12) United States Patent
Simell et al.

(10) Patent No.: US 11,643,782 B2
(45) Date of Patent: May 9, 2023

(54) METHOD FOR CONTROLLING GROWTH OF MICROORGANISMS AND/OR BIOFILMS IN AN INDUSTRIAL PROCESS

(71) Applicant: Kemira Oyj, Helsinki (FI)

(72) Inventors: Jaakko Simell, Helsinki (FI); Marko Kolari, Vantaa (FI); Jonas Konn, Espoo (FI)

(73) Assignee: Kemira Oyj, Helsinki (FI)

( * ) Notice: Subject to any disclaimer, the term of this patent is extended or adjusted under 35 U.S.C. 154(b) by 408 days.

(21) Appl. No.: 16/640,069

(22) PCT Filed: Aug. 28, 2018

(86) PCT No.: PCT/EP2018/073109
§ 371 (c)(1),
(2) Date: Feb. 19, 2020

(87) PCT Pub. No.: WO2019/042985
PCT Pub. Date: Mar. 7, 2019

(65) Prior Publication Data

US 2020/0199818 A1 Jun. 25, 2020
US 2022/0056641 A2 Feb. 24, 2022

(30) Foreign Application Priority Data

Aug. 29, 2017 (EP) ..... 17188319

(51) Int. Cl.
*D21H 21/04* (2006.01)
*D21H 21/36* (2006.01)
*D21H 17/09* (2006.01)
*D21H 17/14* (2006.01)

(52) U.S. Cl.
CPC ..... *D21H 21/04* (2013.01); *D21H 17/09* (2013.01); *D21H 17/14* (2013.01); *D21H 21/36* (2013.01)

(58) Field of Classification Search
None
See application file for complete search history.

(56) References Cited

U.S. PATENT DOCUMENTS 2,564,430 A 8/1951 Gillaspie
3,159,532 A * 12/1964 Birum ..... C07C 317/00 558/397
3,976,668 A * 8/1976 Richter ..... 564/162
4,331,480 A 5/1982 Gutman et al.
4,420,484 A 12/1983 Gorman et al.
4,617,328 A * 10/1986 Liu ..... C08K 5/41 524/172
5,128,051 A 7/1992 Theis et al.
5,198,453 A 3/1993 LaZonby et al.
5,324,432 A 6/1994 Robertson et al.
5,785,867 A 7/1998 LaZonby et al.
6,096,225 A 8/2000 Yang et al.
2004/0157931 A1 8/2004 Ra
2005/0147528 A1 7/2005 Shim et al.
2006/0008496 A1 1/2006 Kulkarni et al.
2011/0177147 A1 7/2011 Hunter et al.
2013/0302443 A1 11/2013 Janak
2018/0142537 A1 5/2018 Baldoni-Andrey et al.
2021/0127677 A1 5/2021 Simell et al.

FOREIGN PATENT DOCUMENTS

CN 101239056 A 8/2008
CN 101909437 A 12/2010
CN 102086615 A 6/2011
CN 102803157 A 11/2012
CN 104936448 A 9/2015
CN 105142602 A 12/2015
JP S5195129 A 8/1976
JP S5221321 A 2/1977
JP S57135840 A 8/1982
(Continued)

OTHER PUBLICATIONS

Smook, Gary A., Handbook for Pulp and Paper Technologists, 2nd ed, Angus Wilde Publications, 1992, pp. 4-6, 207-208, 220 (Year: 1992).*
Jaakko Ekman et al.: "Detection and quantitation of colored deposit-forming *Meiothermus* spp. in paper industry processes and end products", Journal of Industrial Microbiology & Biotechnology; Official Journal of the Society for Industrial Microbiology, Springer, Berlin, DE, vol. 34, No. 3, Nov. 28, 2006, pp. 203-211, XP019476516.
Peltola, Minna et al.: "Effects of polarization in the presence and absence of biocides on biofilms in a simulated paper machine water", J ind Microbiol Biotechnol (2011) 38:1719-1727.
Desjardins, Elyse et al.: "Identification of bacteria contaminating pulp and a paper machine in a Canadian paper mill" J Ind Microbiol Biotechnol (2003) 30: 141-145.
(Continued)

*Primary Examiner* — Dennis R Cordray
(74) *Attorney, Agent, or Firm* — Meunier Carlin & Curfman LLC

(57) ABSTRACT

Disclosed is a method for controlling a biofilm removing a formed biofilm and/or controlling a growth of microorganisms, preferably bacteria, in an aqueous environment of an industrial manufacturing process including a cellulosic fibre material. A compound according to Formula I is administered to the aqueous environment, in which Formula I R1, R2 and R3 independently represent a hydrogen atom; halogen atom; hydroxy group; amino group; alkylamino group, alkyl group, hydroxyalkyl group, haloalkyl group or alkoxy group having 1 to 4 carbon atoms; or an acylamido group having 1 to 10 carbon atoms; and A represents 2-thiazolamine; 2-propenenitrile; 2-propenoic acid; alkyl ester or hydroxyalkyl ester of 2-propenoic acid having 1 to 4 carbon atoms; or —CHCHCONR5R6 group, where R5 and R6 represent independently hydrogen atom, alkyl or hydroxyalkyl having 1 to 4 carbon atoms, with the proviso that the compound according to Formula I is not 3-[(4-methylphenyl)sulphonyl]-2-propenenitrile or 4-amino-N-2-thiazolylbenzenesulphonamide.

22 Claims, No Drawings

(56) References Cited

FOREIGN PATENT DOCUMENTS

| | | | |
|---|---|---|---|
| JP | H03137986 | A | 6/1991 |
| JP | H04166288 | A | 6/1992 |
| JP | H07265866 | A | 10/1995 |
| JP | H1135410 | A | 4/1997 |
| JP | H11130610 | A | 5/1999 |
| JP | 2002524257 | | 8/2002 |
| JP | 2005060351 | A | 3/2005 |
| JP | 2005519089 | A | 6/2005 |
| JP | 2007045715 | A | 2/2007 |
| JP | 2014509253 | A | 4/2014 |
| JP | 2020512793 | A | 4/2020 |
| RU | 2405080 | C2 | 11/2010 |
| WO | 94/09209 | A1 | 4/1994 |
| WO | 99/44424 | A1 | 9/1999 |
| WO | 2007125154 | A1 | 11/2007 |
| WO | 2008146594 | A1 | 12/2008 |
| WO | 2009143511 | A1 | 11/2009 |
| WO | 2012025228 | A1 | 3/2012 |
| WO | 2013045638 | A1 | 4/2013 |
| WO | 2014114851 | A1 | 7/2014 |

OTHER PUBLICATIONS

V.G. Belikov, Pharmaceutical Chemistry, training manual, 2007; Moscow, Medpressinform, p. 27-29. With English translation 6p.

G.Dyson, P. May; The Chemistry of Synthetic Drugs, M:Mirs, 1964, p. 12-19. With English translation 16p.

Search report of Federal Service for Intellectual Property for copending Russioan application 2020110929, dated Oct. 22, 2021. With English translation 4p.

Office Action in Chinese patent application No. 201880056644.9, dated Sep. 27, 2021, 6 pages.

Kolari, M. et al., Colored moderately thermophilic bacteria in paper-machine biofilms, Journal of Industrial Microbiology and Biotechnology, Apr. 17, 2003, 14 pages.

Viachine translation of Notice of reasons for refusal issued by Japanese Patent Office on application JP2020-512798. Office action dated Jun. 10, 2022.

* cited by examiner

METHOD FOR CONTROLLING GROWTH OF MICROORGANISMS AND/OR BIOFILMS IN AN INDUSTRIAL PROCESS

PRIORITY

This application is a U.S. national application of the international application number PCT/EP2018/073109 filed on Aug. 28, 2018 and claiming priority of European application 17188319.2 filed on Aug. 29, 2017 the contents of all of which are incorporated herein by reference.

The present invention relates to a method for controlling growth of microorganisms and/or biofilms in an industrial process according to the preamble of the enclosed independent claim.

Microorganisms are present in most of the industrial processes. Their presence is especially cumbersome in processes which are water intensive, such as manufacture of pulp, paper, board or the like. Microorganisms thrive when the process water contains biodegradable dissolved substances and the temperature and pH of the process water are favourable for microbial life. Microorganisms may enter the process through contamination from air, incoming raw water and/or non-sterile raw materials. If no countermeasures are taken, microorganisms may cause extensive problems in a process, such as papermaking. Problems related to microorganisms include, for example, decomposition of chemical additives, detrimental change in process pH, formation of malodorous or toxic compounds, and/or biofilm formation on surfaces.

In manufacture of paper and board the problems may lead to defects, such as spots and holes, in the formed web, or even to web breaks and machine stops, for example when slime slumps are sloughing off. In a pulp, paper or board mill uncontrolled microbial growth could thus cause problems and there is a need for effective microbial control treatment. However, only limited number of antimicrobial agents demonstrate good biocidal performance at the process conditions prevailing in a paper or board manufacture, e.g. high content of cellulosic fibre material, high temperature, high flow rates and high oxidizer demand. Furthermore, in these processes the microorganisms, mainly bacteria, are continuously present and may be introduced in the middle of the continuous process. Due to the process conditions the conventional biocides, which are used in pulp, paper and board industry are different from common antimicrobial agents used in other industries, e.g. food industry or in agriculture. For example, in food industry the environment is sterilized in the beginning whereafter the production continues under sterile conditions and sterile raw materials. These conditions are very different from the non-sterile conditions prevailing in an open paper or board production process. Especially important in processes comprising cellulosic fibre material, such as pulp, paper and board manufacture, is the effective control of biofilm on the process surfaces. Biofilm formation is still a frequent problem in manufacture of paper and board, despite the regular use of common biocides in the recirculating water flows. There is a need to improve efficacy of biofilm control under conditions of pulp, paper and board making processes.

Biofilm formation is a problem in paper and board production, and there is a need to improve efficacy of biofilm control.

An object of this invention is to minimise or possibly even eliminate the disadvantages existing in the prior art.

Another object of the present invention is to provide a method which makes it possible to effectively control biofilms with a low composition dosage in an industrial manufacturing process comprising cellulosic fibre material, for example, in pulp, paper or board manufacture.

An object of the present invention is to provide a method which makes it possible to effectively prevent, inhibit and/or reduce biofilm growth with a low composition dosage in an industrial manufacturing process comprising cellulosic fibre material, for example, in pulp, paper or board manufacture.

An object of the present invention is to provide a method which makes it possible to effectively control the growth of microorganisms in an industrial manufacturing process comprising cellulosic fibre material, for example, in pulp, paper or board manufacture.

Yet another object of the present invention is to provide simple and effective method for industrial biofilm control at high temperatures, especially in aqueous process conditions with high cellulosic fibre content and/or at least locally high shear forces and/or high flow rates.

These objects are attained with the invention having the characteristics presented below in the characterising parts of the independent claims.

Some preferred embodiments of the invention are presented in the dependent claims.

The embodiments mentioned in this text relate, where applicable, to all aspects of the invention, even if this is not always separately mentioned.

In a typical method according to the present invention for controlling biofilm and/or for removing of a formed biofilm and/or for controlling a growth of microorganisms, preferably bacteria, in an aqueous environment of an industrial manufacturing process comprising cellulosic fibre material, by administering to the aqueous environment of the process a composition comprising a compound according to Formula (I)

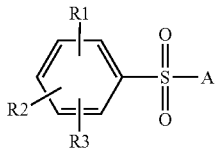

where

R1, R2 and R3 independently each other represent a hydrogen atom; halogen atom; hydroxy group; amino group; alkylamino group, alkyl group, hydroxyalkyl group, haloalkyl group or alkoxy group having 1 to 4 carbon atoms; or an acylamido group having 1 to 10 carbon atoms; and A represents 2-thiazolamine; 2-propenenitrile; 2-propenoic acid; alkyl ester or hydroxyalkyl ester of 2-propenoic acid having 1 to 4 carbon atoms; or —CHCHCONR5R6 group, where R5 and R6 represent independently hydrogen atom, alkyl or hydroxyalkyl having 1 to 4 carbon atoms, with the proviso that the said compound is not 3-[(4-methylphenyl)sulphonyl]-2-propenenitrile or 4-amino-N-2-thiazolyl-benzenesulphonamide.

Now it has been found that the compositions comprising at least one compound according to Formula (I) are highly effective in controlling the formation of biofilm and/or growth of microorganisms, in an aqueous environment of an industrial manufacturing process comprising cellulosic fibre material, especially in paper, board and pulp manufacture. The obtained effect is good even at low dosage of the compound and in aqueous environments having high flow rate and/or high temperature. It was unexpected that the compounds according to Formula (I) would show antimicrobial performance that is as good as or even better than the conventional antimicrobial agents used against biofilms in pulp and paper industry. The compounds according to Formula (I) are useful in providing an anti-bacterial effect and controlling the growth of biofilm and/or bacteria.

In the present context of the term "controlling of biofilm growth" encompasses control actions selected at least from preventing, inhibiting and/or reducing of biofilm. These control actions may take place before, during or after biofilm formation and the control actions may take place separately or simultaneously, for example the compound according to Formula (I) may both prevent formation of new biofilm and simultaneously reduce the existing biofilm. The compound according to Formula (I) may be useful in preventing of biofilm. This means that the compound prevents formation of biofilm on biofilm free process surfaces. The compound may also be useful in inhibiting of biofilm. This means that the compound inhibits further growth of existing biofilm and/or inhibits formation of a biofilm on biofilm free process surface. The compound may further be useful in reducing the biofilm. This means that the compound reduces the amount of existing biofilm on the process surfaces. In general, control of biofilm growth may be achieved by controlling the amount of microorganisms in the process and/or by controlling their growth in biofilm mode. The compound according to Formula (I) may be useful in controlling the growth of microorganisms, either in biofilm and/or free in the aqueous environment of an industrial manufacturing process comprising cellulosic fibre material, preferably in biofilm.

In the present context the term "biofilm" is understood as a community of microorganisms, typically bacteria, which adheres to a process surface and usually grows surrounded by a complex matrix of extrapolymeric substances. The biofilm protects the microorganisms, which makes the control of biofilm growth more challenging than control of growth of free microorganisms. Ineffective biofilm control may cause significant issues in industrial processes, for example in form of increased cleaning need, production stops and/or deterioration of production quality and/or quantity.

In the present context the term "controlling of the growth of the microorganisms" refers to eliminating and/or reducing of the amount and/or activity of microorganisms and the term is synonymous to any biostatic or biocidal effect, such as killing, preventing, removing, or inhibiting the growth of microorganisms. The microorganisms may be present in free form in the aqueous environment or in a form of a biofilm, known also as biofilm mode of growth In the present context the term "aqueous environment" refers to an industrial water system, containing aqueous solution. The present invention relates especially to industrial processes having an aqueous environment comprising cellulosic fibre material of natural origin. According to one embodiment of the invention the temperature of the aqueous environment is at least 40° C., preferably at least 50° C.

Especially the composition of the present invention is suitable for administering or use in industrial manufacturing processes comprising cellulosic fibre material, such as manufacture of paper, board, pulp, tissue, moulded pulp, non-woven, viscose or the like. The aqueous environment comprises preferably at least water, cellulosic fibre material, fines and/or fibre fragments of natural origin. The aqueous environment may also comprise starch. The cellulosic fibre material preferably originates from softwood, hardwood or non-wood sources, such as bamboo or kenaf, or any mixtures thereof. Preferably the cellulosic fibre material originates from lignocellulosic fibre material. More preferably the cellulosic fibre material is lignocellulosic fibres. The cellulosic fibre material may originate from any suitable mechanical, chemi-mechanical or chemical pulping process or any of their combinations or any other suitable pulping process known as such. The cellulosic fibre material may also comprise fibre material which originates from recycled board, paper or pulp. For example, the cellulosic fibre material may comprise cellulosic fibres that originate from hardwood and have a length of 0.5-1.5 mm and/or from softwood and have a length of 2.5-7.5 mm. The aqueous environment may also comprise inorganic mineral particles, such as fillers and/or coating minerals; hemicelluloses; lignin; and/or dissolved and colloidal substances. The aqueous environment may also comprise papermaking additives, such as starch, sizing agents, inorganic or organic coagulation or flocculation agents, natural or synthetic polymers of different length and/or charge, dyes, optical brighteners or any combination thereof.

According to one embodiment of the invention the compound according to the Formula (I) is such that R1 represents methyl group; ethyl propyl group; butyl group; methoxy group; ethoxy group; propoxy group; isopropoxy group; n-butoxy group; or tertiary butoxy group; and R2 and R3 represent independently hydrogen atom; methyl group; ethyl propyl group; butyl group; methoxy group; ethoxy group; propoxy group; isopropoxy group; n-butoxy group; tertiary butoxy group; and A represents 2-propenenitrile; and R1, R2, R3 may be located independently in ortho, meta or para position in relation to A. It has been observed that these compounds are especially effective in reducing biofilm formation and/or growth of microorganisms.

According to another embodiment of the invention the compound according to the Formula (I) is such that R1 represents methyl group; ethyl propyl group; butyl group; methoxy group; ethoxy group; propoxy group; isopropoxy group; n-butoxy group; tertiary butoxy group; or amino group; and R2 and R3 represent independently hydrogen atom; methyl group; ethyl propyl group; butyl group; methoxy group; ethoxy group; propoxy group; isopropoxy group; n-butoxy group; tertiary butoxy group; and A represents —CHCHCONR5R6 group, where R5 and R6 represent independently hydrogen atom; alkyl or hydroxyalkyl having 1 to 4 carbon atoms; preferably R5 and R6 representing hydrogen atoms; and R1, R2. R3 may be located independently in ortho, meta or para position relative to A. These compounds have also shown surprising effect in reducing the biofilm formation and/or growth of microorganisms.

In general when R1, R2 or R3 is haloalkyl, it may be trifluoromethyl.

The compound according to Formula (I) may be selected from a group consisting of 3-phenylsulphonyl-2-propenenitrile, 3-[(4-fluorophenyl)sulphonyl]-2-propenenitrile, 3-[(2,4-dimethylphenyl)sulphonyl]-2-propenenitrile, 3-[(4-trifluormethylphenyl)-sulphonyl]-2-propenenitrile, 3-[(3,4-dimethylphenyl)sulphonyl]2-propenenitrile, 3-(3,5-dimethylphenyl)sulphonyl-2-propenenitrile, 3-[(2,4,6-trimethylphenyl)-sulphonyl]-2-propenenitrile, 3-(4-methoxyphenyl)sulphonyl-2-propenenitrile, (3-[(4-methylphenyl)sulphonyl]prop-2-enamide, 3-[(4-methylphenyl)sulphonyl]prop-2-enoic acid, and any of their isomers. According to one preferable embodiment of the present invention the compound according to Formula (I) is selected from a group consisting of 3-phenylsulphonyl-2-propenenitrile; 3-[(4-trifluormethylphenyl)-sulphonyl]-2-propenenitrile; 3-[(2,4,6-trimethylphenyl)sulphonyl]-2-propenenitrile; 3-(4-methoxyphenyl)sulphonyl-2-propenenitrile; 3-[(4-methylphenyl)sulphonyl]prop-2-enamide; and any of their isomers.

The compositions used in the present method do not comprise 3-[(4-methylphenyl)sulphonyl]-2-propenenitrile or 4-amino-N-2-thiazolyl-benzenesulphonamide, i.e. the compositions are free of these compounds.

The composition may comprise compound(s) according to Formula (I) in form of a Z- or E-isomer, or the composition may comprise these compounds as a mixture of both isomers. For example, the ratio of E to Z isomers in the composition may be from 70:30 to 100:0 or from 80:20 to 99:1. Alternatively the ratio of E to Z isomers in the composition may be from 30:70 to 0:100 or from 20:80 to 1:99 According to one embodiment of the invention it is possible to administer to the industrial manufacturing processes comprising cellulosic fibre material a composition comprising one or several compounds according to Formula (I). In case several compounds according to Formula (I) are administered to the aqueous environment, they may be administered as one composition, i.e. as a mixture, or they may be administered as separate compositions successively after each other. In case several compounds according to Formula (I) are administered, the individual dosages for each compound may be the same or different from each other. In this manner it is possible to effectively control the biofilm and/or microorganisms in the aqueous environment.

The present invention is suitable for controlling the growth of microorganisms, such as bacteria, belonging to genus of *Meiothermus, Deinococcus* and/or *Pseudoxanthomonas* in the aqueous environment. According to one embodiment of the invention the aqueous environment of the industrial manufacturing process, which comprises cellulosic fibre material, thus comprises bacteria belonging to genus of *Meiothermus, Deinococcus* and/or *Pseudoxanthomonas*, either alone or in any combination, or the aqueous environment is in contact with a biofilm at least partially formed by any of the said bacteria. The microorganisms in the said industrial processes are typically not photosynthetic microorganisms, i.e. preferably the aqueous environment is almost or completely free of photosynthetic microorganisms, e.g. algae. Addition of the compound according to Formula (I) reduces the amount of the said microorganisms, either in free form or as biofilm, or even eliminates their presence in the aqueous environment completely. The elimination may be total or partial. The prevention refers here to any preventive eliminating action which reduces or inhibits the growth of the microorganisms in biofilm mode and thereby totally or partially prevents the formation of the biofilm.

In general the composition comprising compound according to Formula (I) may be added to the aqueous environment in biostatic or biocidal amounts. Biostatic amount refers to an amount sufficient to at least prevent and/or inhibit the activity and/or growth of the microorganisms or the biofilm. Biocidal amount refers to more effective activity, such as to an amount capable of reducing the activity and/or growth of the microorganisms or the biofilm and/or killing most or all of the microorganisms present in the aqueous environment. According to one embodiment of the invention the compound according to Formula (I) may be added to the aqueous environment in dosage amount of 0.01-100 ppm, preferably 0.01-10 ppm, more preferably 0.01-2 ppm or 0.01-1 ppm, even more preferably 0.01-0.5 ppm or 0.01-0.3 ppm, calculated as active ingredient which is here understood as compound(s) according to Formula (I). The effectiveness of the compound enables the use of low dosage and low concentrations while maintaining good control of microorganisms growth and biofilm formation and/or growth.

Compounds according to Formula (I) may be added to the aqueous environment as a solid, such as dry powder, or more preferably in a liquid form. Compound may be dosed continuously or periodically. According to one embodiment of the invention the composition comprising the compound according to Formula (I) may be administered periodically in the aqueous environment for 3-45 minutes for 6-24 times a day, preferably for 10-30 minutes for 12-24 times a day.

According to one embodiment of the invention the industrial manufacturing process has an aqueous environment comprising cellulosic fibre material of natural origin and is pulp and/or paper and/or board manufacturing process, where the aqueous environment shows high temperature and/or high flow rate. The composition comprising the compound according to Formula (I) is thus added or dosed to a pulp and/or paper and/or board manufacturing system. The aqueous environments in these processes often show high flow and high shear rates, which may induce the formation of biofilm on the process surfaces due to the stress of microorganisms. For example, paper and board making environments the flow rates may typically be higher than 1 m/s, even over 10 m/s, typically from 1 to 20 m/s or from 1 to 10 m/s. It has been observed that the composition comprising the compound according to Formula (I) is effective especially in these demanding conditions, and it may be generally used throughout the whole process in order to reduce and/or to prevent the growth of microorganisms and the formation of biofilm on the process surfaces. In principle, the composition comprising the compound according to Formula (I) may be added at almost any point in the process, especially into process with recirculated process water to maintain the control of microorganisms and/or biofilm formation throughout the process. The composition comprising a compound according to Formula (I) may also or alternatively added to raw material flow. For example, the composition comprising a compound according to Formula (I) may be added to cellulosic fibre material, e.g. lignocellulosic fibre material, which is used as a raw material in the process.

The industrial manufacturing process having an aqueous environment comprising cellulosic fibre material of natural origin may be pulp and/or paper and/or board manufacturing process, where the pH of the aqueous environment is in the range 5-9, preferably 7-8.5.

According to one preferable embodiment of the present invention the compound according to Formula (I) may be added in the industrial manufacturing process having an aqueous environment comprising cellulosic fibre material, which is paper and/or board manufacturing process, especially in a short loop of the paper or board making process. In a typical paper and board making process, pulp stock is passed into a headbox, which distributes the pulp stock onto a moving wire in a forming section, on which the continuous paper web is formed. The short loop or short circulation section of a paper/board machine is here understood, as customary in the art, the part of the manufacturing system that re-circulates and recycles at least a part of excess water from the pulp stock, collected in a wire pit in the forming section, back to the headbox for re-use.

Alternatively, or in addition, the compound according to Formula (I) may be added in the industrial manufacturing process having an aqueous environment comprising cellulosic fibre material, e.g. pulp and/or paper and/or board manufacturing process, to process water storage towers, such as circulating water towers and filtrate water towers; to clear or cloudy filtrate storage tanks; pulpers; aqueous streams upstream/downstream of the pulpers; broke system and aqueous process streams upstream/downstream of vessels therein; wire pit process streams up-stream/downstream of the pit; paper machine blend chest process streams up-stream/downstream of the chest; fresh water tank; warm water tank and/or shower water tank.

Alternatively, or in addition, the compound according to Formula (I) may be added in the industrial manufacturing process having an aqueous environment comprising cellulosic fibre material, which is paper and/or board manufacturing process, to any location in a long loop of the paper or board making process. The long loop or long circulation section of a paper/board machine is here understood, as customary in the art, the part of the manufacturing system that handles excess water and broke. Major part of the recovered water exit the short loop and is pumped to long loop, which includes: save-all for capturing useful fibres from the recovered water for reuse, storage tanks for filtrate water used for example in machine showers, and storage tanks for recirculated water used for example as dilution water for importing pulp from pulp mill to paper/board machine. A part of the long loop is the broke system for handling of wet and dry paper rejects from the machine. This material is repulped and reused as a part of the pulp stock.

According to one embodiment the compound according to Formula (I) is added to aqueous environment, which comprises a residual of peroxide from about 0.01 to about 100 ppm or from about 0.01 to about 50 ppm.

According to one embodiment of the invention the compound according to Formula (I) may be used in combination with other biocidal or antimicrobial agents. Suitable other biocidal or antimicrobial agents can be non-oxidizing biocidal or antimicrobial agents, or oxidizing biocidal or antimicrobial agents. Suitable non-oxidizing biocidal or antimicrobial agents are, for example, glutaraldehyde, 2,2-dibromo-3-nitrilopropionamide (DBNPA), 2-bromo-2-nitropropane-1,3-diol (Bronopol), quaternary ammonium compounds, carbamates, 5-chloro-2-methyl-4-isothiazolin-3-one (CMIT), and 2-methyl-4-isothiazolin-3-one (MIT). Suitable oxidizing biocidal or antimicrobial agents are, for example, chlorine, salts of hypochlorite, hypochlorous acid, chlorinated isocyanurates, bromine, salts of hypobromite, hypobromous acid, bromine chloride, chlorine dioxide, ozone, hydrogen peroxide, and peroxy compounds, such as peracetic acid or performic acid. Other suitable oxidizing biocidal agents are, for example, stabilized halogen compounds wherein active halogen, such as chlorine or bromine is reacted with a nitrogenous compound, such as dimethylhydantontoin, an ammonium salt, urea, carbamate, or another nitrogen containing molecule capable of reacting with active halogen. For example, in one embodiment the compound according to Formula (I) is added to aqueous environment, which comprises a residual of active halogen in the range from about 0.01 to about 20 ppm, given as active chlorine.

EXPERIMENTAL

Some embodiments of the invention are described more closely in the following non-limiting examples.

Materials and Methods Used in the Examples

Pure cultures of *Meiothermus silvanus*, a microbe species commonly found in paper machine biofilms (Ekman J, Journal of Industrial Microbiology & Biotechnology 34:203-211) and *Pseudoxanthomonas taiwanensis*, another species commonly found in paper machine environments (Desjardins, E & Beaulieu, C, Journal of Industrial Microbiology & Biotechnology 30:141-145) were used to study the efficacy of various chemicals to prevent biofilm formation.

Biofilm tests were done in either synthetic commercial R2-broth (Lab M Ltd, UK) or fibre-containing synthetic paper machine water, SPW (prepared according to Peltola, et al., J. Ind. Microbiol. Biotechnol. 2011, 38: 1719-1727) using 96-microwell plate wells with peg lids (Thermo Fischer Scientific Inc., USA). Plates were incubated at 45° C. with a rotary shaking (150 rpm) providing high flow in each well.

2,2-dibromo-3-nitrilopropionamide, hereinafter called DBNPA, was obtained from Kemira Oyj (Fennosan R20, 20% active ingredient).

(2E)-3-phenylsulphonyl-2-propenenitrile, hereinafter called Compound C was synthesised as follows:

1.066 g (0.00533 mol) of $C_6H_5SO_2Na\times2H_2O$ was weighed into 50 ml flask. 3 ml $H_2O$ and 1 ml AcOH were added followed by stirring until complete dissolution. 0.466 g (0.00533 mol, 1 eq.) of 2-chloroacrylonitrile was added to the clear solution. Mixture was stirred for 0.5 h, followed by addition of 7 ml of $H_2O$ and extra 15 minutes of stirring. The mixture was left to refrigerator overnight. After that mixture was filtered, washed with 50 ml cold water and dried on lyophilizer. Mass of the intermediate product was 0.900 g (yield 73.6%). The intermediate product was transferred into 100 ml flask and dissolved in 60 ml of MTBE. 0.396 g of $Et_3N$ was added dropwise instantly forming white precipitate in the solution. Reaction mixture was stirred 1 h. After that, the mixture was filtered and the residue was washed with 20 ml MTBE. Filtrate was extracted with 2×50 ml 1 M $KHSO_4$ solution. After that, organic phase was evaporated under reduced pressure and the residue was dried on lyophilizer.

Mass of the product was 0.667 g (yield 88.1%). Purity (HPLC): 99.1%.

$^1$H NMR: ($CDCl_3$, 700 MHz) δ 7.96-7.87 (m, 2H), 7.74 (s, 1H), 7.63 (s, 2H), 7.24 (d, J=15.7 Hz, 1H), 6.55 (d, J=15.7 Hz, 1H).

(2E)-3-[(2,4,6-trimethylphenyl)sulphonyl]-2-propenenitrile, hereinafter called Compound D, was synthesised as follows:

300 mg (1.45 mmol) sodium 2,4,6-trimethylphenyl sulphinate was dissolved in mixture of 0.18 ml acetic acid and 0.5 ml of water. 115 μl (126 mg, 1.44 mmol) 2-chloroacrylonitrile was added and the mixture was stirred for 1 h at room temperature. After this time, 0.5 ml of water was added and the mixture was stirred for additional 20 minutes. The product precipitated as oil (very slightly yellow), it could not be separated by filtration. The reaction mixture was neutralised to pH 6.8 using saturated solution of $NaHCO_3$ and extracted with MTBE (4×3 ml).

Combined MTBE fractions were analysed and 221 μl (160 mg, 1.58 mmol, 1.1 eq) trimethylamine was added. The mixture was stirred for 1 h at room temperature, extracted twice with 1M $KHSO_4$ (3 ml) and once with sat. NaCl solution (5 ml), dried over $Na_2SO_4$ and evaporated to dryness. 60 mg of slightly yellow solid was obtained (yield 17% over 2 steps). The identity of the product was confirmed by 1H and 13C NMR, purity of the product was 94.5% by HPLC.

The reason for low yield was found to be incomplete conversion in the first step—the aqueous phase after extraction of the intermediate with MTBE contained high concentration of the starting sodium 2,4,6-trimethylphenyl sulphonate.

$^1$H NMR: ($CDCl_3$, 700M Hz) δ 7.27 (d, J=15.7 Hz, 1H), 7.02 (d, J=0.5 Hz, 2H), 6.45 (d, J=15.7 Hz, 1H), 2.60 (s, 6H), 2.33 (s, 3H).

$^{13}$C NMR (176 MHz, $CDCl_3$) b 149.54, 145.29, 140.86, 132.77, 130.45, 113.61, 108.96, 22.89, 21.16.

(2E)-3-[(4-trifluormethylphenyl)sulphonyl]-2-propenenitrile, hereinafter called Compound E, was synthesised as follows:

300 mg (1.29 mmol) sodium 4-trifluoromethylphenyl sulphinate was dissolved in mixture of 0.16 ml acetic acid and 0.44 ml of water. 103 μl (112 mg, 1.28 mmol) 2-chloroacrylonitrile was added and the mixture was stirred for 1 h at room temperature. After this time, 0.5 ml of water was added and the mixture was stirred for additional 20 minutes. The product precipitated as amorphous, orange solid, it could not be separated by filtration. The reaction mixture was neutralised to pH 6.8 using saturated solution of $NaHCO_3$ and extracted with MTBE (4×3 ml).

MTBE fractions were combined and 195 μl (142 mg, 1.4 mmol, 1.1 eq) trimethylamine was added. The mixture was stirred for 1 h at room temperature, extracted twice with 1M $KHSO_4$ (3 ml) and once with sat. NaCl solution (5 ml), dried over $Na_2SO_4$ and evaporated volume ~1 ml. Product precipitated as light crystals, the mother liquor was orange. 53 mg of slightly yellow solid was obtained (yield 16% over 2 steps). The identity of the product was confirmed by 1H and 13C NMR, purity of the product was 88.4% by HPLC. The reason for low yield was here likely also low conversion in first step and also incomplete precipitation of product from MTBE (which was needed, as the mother liquor was clearly coloured).

$^1$H NMR (700 MHz, $CDCl_3$) δ 8.06 (d, J=8.2 Hz, 2H), 7.90 (d, J=8.3 Hz, 2H), 7.23 (d, J=15.6 Hz, 1H), 6.63 (d, J=15.6 Hz, 1H).

$^{13}$C NMR (176 MHz, $CDCl_3$) δ 148.09 (s), 140.96 (s), 136.68 (q, J=33.4 Hz), 129.19 (s), 127.11 (q, J=3.6 Hz), 122.84 (d, J=273.4 Hz), 112.97 (s), 112.18 (s).

(2E)-3-[(4-methoxyphenyl)sulphonyl]-2-propenenitrile, hereinafter called Compound F, was synthesised as follows:

1.257 g (0.00998 mol, 2 eq.) of $Na_2SO_3$ and 0.846 g (0.01007 mol, 2 eq) of $NaHCO_3$ was weighted into 50 ml flask and dissolved in 30 ml of $H_2O$/THF 10:1. The solution was cooled down in ice bath and 1.064 (0.00515 mol, 1 eq.) of para-methoxyphenylsulphonyl chloride was added dropwise during 5 min. Reaction mixture was stirred for 3 hours at room temperature. After that, the clear reaction mixture was extracted with 3×20 ml $CHCl_3$. Water phase was evaporated under reduced pressure and the residue was stirred with 2×25 ml of MeOH followed by filtration. The solid inorganic residue was removed and the filtrate was evaporated under reduced pressure. Circa 4 g of white solid material was obtained (yield over 100% due to presence of inorganic components). This material was used in the next step without further treatment.

The material was transferred into 50 ml flask and dissolved in the mixture of 7 ml $H_2O$ and 2.8 ml AcOH. After that, 0.410 ml (0.451 g, 0.00515 mol) of 2-chloroacrylonitrile was added dropwise. The mixture was stirred for 50 minutes before 4 ml $H_2O$ was added followed by extra 15 minutes of stirring. Clear oil-like substance precipitated out. pH of the reaction mixture was increased to 6.85 with saturated $NaHCO_3$ solution; oil was dissolved. Reaction mixture was extracted with 3×25 ml MTBE and organic phases were transferred into 250 ml flask. This solution was used directly in next step without further treatment.

0.720 ml (0.523 g, 0.00517 mol) of Et3N was added to the obtained solution. The reaction mixture was stirred for 1 h. Reaction mixture was washed with 2×50 ml of 1 M $KHSO_4$ solution and 10 ml of saturated NaCl solution. Organic phase was evaporated under reduced pressure and dried on lyophilizer. The mass of the final product was 0.639 g (yield 55% over 3 steps). HPLC purity 93.5%. Identity of compound 1 K was confirmed with NMR.

$^1$H NMR (700 MHz, $CDCl_3$) δ ppm 3.92 (s, 3H) 6.50 (d, J=15.61 Hz, 1H) 7.08 (d, J=9.05 Hz, 2H) 7.23 (d, J=15.61 Hz, 1H) 7.83 (d, J=9.06 Hz, 2H)

$^{13}$C NMR (176 MHz, $CDCl_3$) δ ppm 55.92 (s) 109.53 (s) 113.53 (s) 115.24 (s) 128.32 (s) 130.92 (s) 149.59 (s) 164.93 (s)

(2E)-3-[(4-methylphenyl)sulphonyl]prop-2-enamide, hereinafter called Compound G, was synthesised as follows:

3.26 g (0.0469 mol) $NH_2OH$×HCl was dissolved in 50 ml of NaOH (1M)/THF 1:1 in 100 ml flask. The solution was cooled down in ice bath and 2.54 g (0.0630 mol, 1.3 eq.) of acetaldehyde was added. The mixture was stirred at room temperature for 6 hours. pH of the reaction mixture was around 1. After the reaction, the solution was neutralized with 2 M NaOH. As it was desired to reduce the amount of THF in the mixture for next synthesis step, the mixture was evaporated a bit under vacuum at 40° C. After 5 min of evaporation (around 10 ml evaporated), colour of the solution turned slightly pink and evaporation was stopped. The mixture was left overnight into refrigerator.

1.009 g (0.00487 mol) of nitrile was added to the prepared mixture. Around 100 mg of NiCl2×6$H_2O$ was added to the mixture as catalyst and the reaction mixture was heated to reflux. Formation of the product was monitored with TLC (PE/EA 5:1).

After 2 hours, the reaction mixture had brown colour, TLC showed that almost all nitrile had already reacted. As the product didn't move on TLC with solvent PE/EA 5:1, new solvent $CHCl_3$/MeOH 10:1 was used instead. This indicated that after 4 hours of reflux, nitrile wasn't anymore present in the solution, also pure product spot without any significant impurities were notified. Reflux was ended and the mixture was cooled to room temperature. After further cooling in ice bath, mixture was filtered and washed with 100 ml of water. Light gray product was left to dry on lyophilizer overnight.

Mass of the product was 0.461 g. For further purification, column chromatography with eluent $CHCl_3$/MeOH 10:1 was performed. 50 g of medium size silica gel was used and 18 fractions (50 ml each) were collected. Each fraction was analysed with TLC ($CHCl_3$/MeOH 10:1). In the first fraction, there were impurities and therefore fractions 2-9 were collected. Fractions 10-18 didn't contain significant amount of the product. Solution (fractions 2-9) was evaporated under vacuum and dried in lyophilizer. Mass of the final product was 0.317 g. HPLC Purity: 94.4%.

$^1$H NMR (700 MHz, DMSO) δ 8.02 (s, 1H), 7.82-7.78 (m, 2H), 7.67 (s, 1H), 7.50-7.47 (m, 2H), 7.41 (d, J=15.0 Hz, 1H), 6.95 (d, J=15.0 Hz, 1H), 2.41 (s, 3H). $^{13}$C NMR (176 MHz, DMSO) δ 163.13, 145.07, 139.28, 135.95, 134.80, 130.25, 127.75, 21.11.

Test Method for Prevention of Biofilm Formation

For experiments of preventing biofilm formation wells of 96-microwell plates with peg-lids were filled with R2-broth or SPW, inoculated with the pure bacterial cultures and treated with different amounts of chemical compounds to be tested. Peg-lid was put on. After 24 hours the wells were emptied and a fresh solution of pure culture containing SPW or R2 broth with different amounts of test chemicals were added to the wells and the original peg-lid was put back in place. After an additional 24 hours, i.e. 48 hours after starting the test, the wells were emptied, rinsed and the peg lid and wells were left to dry.

Test Method for Removal of Existing Biofilm

For experiments of removing already existing (pre-formed) biofilm wells of 96-microwell plates with peg-lids were filled with SPW, inoculated with the pure bacterial cultures. Biofilm was grown for 24 hours without addition of any chemical compound to be tested. In some experiments after 24 hours the procedure was repeated by emptying the wells and by addition of a fresh solution of SPW inoculated with pure bacterial culture, again without any test chemical compound. The original peg-lid was put back in place and biofilm was allowed to grow for additional 24 h, i.e. in total 48 h.

After 24 or 48 hours after starting the test, the wells were emptied and a fresh solution of SPW, inoculated with the pure bacterial cultures and with different amounts of chemical compounds to be tested were added and the original peg-lid was placed back in place. After an additional 2 or 24 hours the wells were emptied, rinsed and the peg lid and wells were left to dry.

Quantification of Formed Biofilm

The amount of biofilm formed on the microwells and peg surfaces was quantified with a staining solution by adding 200 μl of 1% Crystal Violet (Merck Millipore KGaA, Germany) in methanol to each well and placing the peg-lid back on. After 3 minutes the wells were emptied and the wells and pegs were rinsed 3 times with tap water. The attached Crystal Violet was dissolved into ethanol and the absorbance at 595 nm was measured. The values shown in the following tables are average absorbance from 8 replicate wells and pegs.

All absorbance values in Examples 1-8 are given actual measured values. In calculation for biofilm reduction percentages it was taken in account that the SPW alone for 2 days without any bacterial inoculum gave a background value of 0.14.

Example 1 (Reference)

Tables 1 and 2 demonstrate the ability of a conventional antimicrobial agent DBNPA to prevent biofilm formation of *Meiothermus silvanus* and *Pseudoxanthomonas taiwanensis*. Test conditions simulated paper or board making process conditions (synthetic paper machine water, high temperature, fibres present, high flow). The conventional antimicrobial agent DBNPA required a dosage of 1 mg/l active compound to reach acceptable or noticable biofilm reduction efficacy. The results for DBNPA are given in Tables 1 and 2.

Table 1 shows the effect of DPNPA dosing to *Meiothermus silvanus* biofilms in SPW at 45° C. and 150 rpm (high mixing). Biofilm was stained and quantified by absorbance measurement. Dosage given as active ingredient.

TABLE 1

| | Biofilm quantity after 48 h contact time | |
|---|---|---|
| Dosage of DBNPA [mg/l] | Abs. at 595 nm | Biofilm reduction [%] |
| 0 | 0.66 | |
| 0.2 | 0.57 | 16.9 |

TABLE 1-continued

| | Biofilm quantity after 48 h contact time | |
|---|---|---|
| Dosage of DBNPA [mg/l] | Abs. at 595 nm | Biofilm reduction [%] |
| 0.6 | 0.35 | 60.7 |
| 1 | 0.15 | 98.8 |

Table 2 shows the effect of DPNPA dosing to *Pseudoxanthomonas taiwanensis* biofilms in SPW at 45° C. and 150 rpm (high mixing). Biofilm was stained and quantified by absorbance measurement. Dosage given as active ingredient.

TABLE 2

| | Biofilm quantity after 48 h contact time | |
|---|---|---|
| Dosage of DBNPA [mg/l] | Abs. at 595 nm | Biofilm reduction, [%] |
| 0 | 1.65 | |
| 0.2 | 1.46 | 12.6 |
| 0.6 | 1.23 | 27.8 |
| 1 | 0.14 | 99.9 |

Example 2 (Reference)

Tables 3 and 4 show effect of a well-known antibiotic Gramicidin against biofilm formation of *Meiothermus silvanus* and *Pseudoxanthomonas taiwanensis*. In a synthetic growth medium R2-broth Gramicidin was capable to prevent biofilm formation at clearly lower concentration than in conditions simulating paper or board making process (synthetic paper machine water, high temperature, fibres present, high flow).

The results in Table 3 and 4 demonstrate expected behaviour of a clinical antimicrobial compound with deteriorating performance when exposed to non-clinical conditions.

Table 3 shows the effect of Gramicidin dosing to *Meiothermus silvanus* biofilms in R2-broth and SPW. Biofilm was stained and quantified by absorbance measurement. Dosage given as active ingredient.

TABLE 3

| | Biofilm quantity after 48 h contact time in R2-broth | | Biofilm quantity after 48 h contact time in SPW | |
|---|---|---|---|---|
| Dosage of Gramicidin [mg/l] | Abs. at 595 nm | Biofilm reduction, [%] | Abs. at 595 nm | Biofilm reduction, [%] |
| 0 | 1.60 | — | 1.36 | — |
| 0.2 | 1.40 | 13.7 | 1.33 | 2.5 |
| 1 | 0.66 | 64.4 | 1.41 | −4.1 |
| 3 | 0.17 | 97.9 | 0.45 | 74.6 |
| 10 | 0.14 | 100.0 | 0.19 | 95.9 |

Table 4 shows the effect of Gramicidin dosing to *Pseudoxanthomonas taiwanensis* biofilms in R2-broth and SPW. Biofilm was stained and quantified by absorbance measurement. Dosage given as active ingredient.

TABLE 4

| Dosage of Gramicidin [mg/l] | Biofilm quantity after 48 h contact time in R2-broth: Abs. at 595 nm | Biofilm reduction, [%] | Biofilm quantity after 48 h contact time in SPW: Abs at 595 nm | Biofilm reduction, [%] |
|---|---|---|---|---|
| 0 | 2.78 | — | 2.37 | — |
| 3 | 2.80 | −0.8 | 2.25 | 5.4 |
| 10 | 2.55 | 8.7 | 2.41 | −1.8 |
| 25 | 0.19 | 98.1 | 2.42 | −2.2 |

Example 3

Tables 5 and 6 demonstrate the ability of Compound C and Compound E to prevent biofilm formation of *Meiothermus silvanus* and *Pseudoxanthomonas taiwanensis. Test conditions are identical to test conditions of Example* 1. It was observed that Compound C and Compound E were able to control biofilms at a very low concentration. Already a dosage of 0.2 mg/I active Compound C or Compound E gave over 90% biofilm reduction effect.

Table 5 shows the effect of Compound C dosage to *Meiothermus silvanus* biofilms in SPW at 45° C. and 150 rpm (high mixing). Biofilm was stained and quantified by absorbance measurement. Compound C dosage is given as active compound.

TABLE 5

| Dosage of Compound C [mg/l] | Biofilm quantity after 48 h contact time: Abs. at 595 nm | Biofilm reduction [%] |
|---|---|---|
| 0 | 0.85 | |
| 0.06 | 0.64 | 29.7 |
| 0.2 | 0.15 | 98.2 |

Table 6 shows the effect of Compound E dosage to *Meiothermus silvanus* biofilms in SPW at 45° C. and 150 rpm (high mixing). Biofilm was stained and quantified by absorbance measurement. Compound E dosage is given as active compound.

TABLE 6

| Dosage of Compound E [mg/l] | Biofilm quantity after 48 h contact time: Abs. at 595 nm | Biofilm reduction [%] |
|---|---|---|
| 0 | 2.25 | |
| 0.06 | 1.43 | 38.8 |
| 0.2 | 0.14 | 99.6 |

Results in Tables 5 and 6 demonstrate that Compound C and Compound E are capable to prevent biofilm formation of dominant industrial biofilm-formers under paper machine conditions at a very low dosage when compared to conventional biocide used in paper industry.

Example 4

Tables 7 and 8 demonstrate the ability of Compound D and Compound F to remove already formed biofilms of *Meiothermus silvanus* or *Pseudoxanthomonas taiwanensis*. Test conditions simulated paper making process conditions (synthetic paper machine water, high temperature, fibres present, high flow). Compound D and Compound F were observed to remove already formed biofilms.

Table 7 shows the effect of Compound D dosage to *Pseudoxanthomonas taiwanensis* biofilms in SPW at 45° C. and 150 rpm (high mixing). Biofilm was pre-grown for 24 h after which Compound D was added in given amount. After 24 hours the biofilm was stained and quantified by absorbance measurement. Compound D dosage is given as active compound.

TABLE 7

| Dosage of Compound D [mg/l] | Biofilm quantity after 24 h pre-growth and 24 h contact time: Abs. at 595 nm | Biofilm reduction [%] |
|---|---|---|
| 0 | 2.25 | |
| 0.2 | 2.07 | 8.4 |
| 0.6 | 0.18 | 97.9 |

Table 8 shows the effect of Compound F dosage to *Meiothermus silvanus* biofilms in SPW at 45° C. and 150 rpm (high mixing). Biofilm was pre-grown for 24 h after which Compound F was added in given amount. After 24 hours the biofilm was stained and quantified by absorbance measurement. Compound F dosage is given as active compound.

TABLE 8

| Dosage of Compound F [mg/l] | Biofilm quantity after 24 h pre-growth and 24 h contact time: Abs. at 595 nm | Biofilm reduction [%] |
|---|---|---|
| 0 | 1.29 | |
| 0.2 | 1.21 | 6.4 |
| 0.6 | 0.86 | 37.3 |

Example 5

Table 9 demonstrates the ability of Compound C to remove already formed biofilms of *Pseudoxanthomonas taiwanensis*. Test conditions simulated paper making process conditions (synthetic paper machine water, high temperature, fibres present, high flow). Compound C was observed to remove already formed biofilms.

Table 9 shows the effect of Compound C dosage to *Pseudoxanthomonas taiwanensis* biofilms in SPW at 45° C. and 150 rpm (high mixing). Biofilm was pre-grown for 24 h after which Compound C was added in given amount. After 24 hours the biofilm was stained and quantified by absorbance measurement. Compound C dosage is given as active compound.

TABLE 9

| Dosage of Compound C [mg/l] | Biofilm quantity after 24 h pre-growth and 24 h contact time: Abs. at 595 nm | Biofilm reduction [%] |
|---|---|---|
| 0 | 1.05 | |
| 0.2 | 0.15 | 98.5 |
| 0.4 | 0.15 | 99.0 |

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A method for controlling a biofilm, for removing a formed biofilm and/or for controlling a growth of microorganisms in an aqueous environment of an industrial manufacturing process comprising a cellulosic fibre material and having a temperature of at least 40° C. and being selected from manufacture of paper, board, pulp, tissue, moulded pulp, or non-woven, the method comprising:

adding continuously or periodically into the aqueous environment, a composition comprising a compound according to (I)

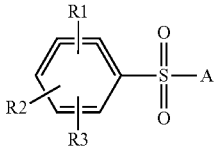

wherein

R1, R2 and R3 independently represent a hydrogen atom; halogen atom; hydroxy group; amino group; alkylamino group, alkyl group, hydroxyalkyl group, haloalkyl group or alkoxy group having 1 to 4 carbon atoms; or an acylamido group having 1 to 10 carbon atoms; and A represents 2-thiazolamine; 2-propenenitrile; 2-propenoic acid; alkyl ester or hydroxyalkyl ester of 2-propenoic acid having 1 to 4 carbon atoms; or —CHCHCONR5R6 group, where R5 and R6 represent independently hydrogen atom, alkyl or hydroxyalkyl having 1 to 4 carbon atoms, with the proviso that said compound is not 3-[(4-methylphenyl)sulphonyl]-2-propenenitrile or 4-amino-N-2-thiazolyl-benzenesulphonamide.

2. The method according to claim 1, wherein in Formula (I):

R1 represents a methyl group; ethyl propyl group; butyl group; methoxy group; ethoxy group; propoxy group; isopropoxy group; n-butoxy group; or tertiary butoxy group; and R2 and R3 represent independently a hydrogen atom; methyl group; ethyl propyl group; butyl group; methoxy group; ethoxy group; propoxy group; isopropoxy group; n-butoxy group; tertiary butoxy group; and A represents 2-propenenitrile;

R1, R2, R3 being located independently in ortho, meta or para position relative to A.

3. The method according to claim 1, wherein in Formula (I):

R1 represents a methyl group; ethyl propyl group; butyl group; methoxy group; ethoxy group; propoxy group; isopropoxy group; n-butoxy group; tertiary butoxy group; or amino group; and R2 and R3 represent independently a hydrogen atom; methyl group; ethyl propyl group; butyl group; methoxy group; ethoxy group; propoxy group; isopropoxy group; n-butoxy group; tertiary butoxy group; and A represents —CHCHCONR5R6 group, where R5 and R6 represent independently hydrogen atom; alkyl or hydroxyalkyl having 1 to 4 carbon atoms;

R1, R2, R3 being located independently in ortho, meta or para position relative to A.

4. The method according to claim 3, wherein R5 and R6 in —CHCHCONR5R6 group represent hydrogen atoms.

5. The method according to claim 1, wherein the compound according to Formula (I) is selected from group consisting of 3-phenylsulphonyl-2-propenenitrile, 3-[(4-fluorophenyl)sulphonyl]-2-propenenitrile, 3-[(4-trifluormethylphenyl)sulphonyl]-2-propenenitrile, 3-[(2,4-dimethylphenyl)sulphonyl]-2-propenenitrile, 3-[(3,4-dimethylphenyl)-sulphonyl]2-propenenitrile, 3-(3,5-dimethylphenyl)sulphonyl-2-propenenitrile, 3-[(2,4,6-trimethylphenyl)sulphonyl]-2-propenenitrile, 3-(4-methoxyphenyl)sulphonyl-2-propenenitrile, 3-[(4-methylphenyl)sulphonyl]prop-2-enamide, 3-[(4-methylphenyl)sulphonyl]prop-2-enoic acid, and any of their isomers.

6. The method according to claim 5, wherein the compound according to Formula (I) is selected from group consisting of 3-phenylsulphonyl-2-propenenitrile, 3-[(4-trifluormethylphenyl)sulphonyl]-2-propenenitrile, 3-[(2,4,6-trimethylphenyl)sulphonyl]-2-propenenitrile, 3-(4-methoxyphenyl)sulphonyl-2-propenenitrile and 3-[(4-methylphenyl)-sulphonyl]prop-2-enamide; and any of their isomers.

7. The method according to claim 1, wherein the composition is administered to the aqueous environment in amount of 0.01-100 ppm, calculated as active compound.

8. The method according to claim 7, wherein the composition is administered in amount of 0.01-10 ppm calculated as active compound.

9. The method according to claim 8, wherein the composition is administered in amount of 0.01-2 ppm, calculated as active compound.

10. The method according to claim 1, wherein the composition is administered to the aqueous environment in amount of 0.01-1 ppm, calculated as active compound.

11. The method according to claim 10, wherein the composition is administered to the aqueous environment in amount of 0.01-0.5 ppm, calculated as active compound.

12. The method according to claim 11, wherein the composition is administered to the aqueous environment in amount of 0.01-0.3 ppm, calculated as active compound.

13. The method according to claim 1, wherein the aqueous environment comprises bacteria belonging to genus of *Meiothermus, Deinococcus* and/or *Pseudoxanthomonas*, either alone or in any combination or the aqueous environment is in contact with a biofilm at least partially formed by any of said bacteria.

14. The method according to claim 1, wherein the aqueous environment comprises water; cellulosic fibres; and further optionally starch; inorganic mineral particles; hemicelluloses; lignin; and/or dissolved and colloidal substances.

15. The method according to claim 14, wherein the cellulosic fibres are lignocellulosic fibres and inorganic mineral particles are selected from fillers and coating minerals.

16. The method according to claim 1, wherein the composition is administered to the aqueous environment, which comprises a residual of peroxide from about 0.01 to about 100 ppm.

17. The method according to claim 1, wherein the temperature of the aqueous environment is at least 50° C.

18. The method according to claim 1, wherein the composition is administered periodically in the aqueous environment for 3-45 minutes for 6-24 times a day.

19. The method according to claim 18, wherein the composition is administered periodically for 10-30 minutes for 12-24 times a day.

20. The method according to claim 1, wherein the composition is used in addition with other biocidal or antimicrobial agents.

21. The method according to claim 20, wherein the composition is administered to the aqueous environment, which comprises a residual of active halogen in the range from about 0.01 to about 20 ppm, given as active chlorine.

22. The method according to claim 1, wherein microorganisms are bacteria.

* * * * *